US007757987B2

(12) United States Patent
Kolbet et al.

(10) Patent No.: US 7,757,987 B2
(45) Date of Patent: Jul. 20, 2010

(54) MOBILE SHREDDER

(75) Inventors: Gary Lee Kolbet, High Point, NC (US); Mel Todd Carswell, Lexington, NC (US); William Len Beusse, Trinity, NC (US); Henry Marshall Kennedy, High Point, NC (US)

(73) Assignee: Vecoplan, LLC, Archdale, NC (US)

( * ) Notice: Subject to any disclaimer, the term of this patent is extended or adjusted under 35 U.S.C. 154(b) by 54 days.

(21) Appl. No.: 11/955,764

(22) Filed: Dec. 13, 2007

(65) Prior Publication Data

US 2009/0152384 A1 Jun. 18, 2009

(51) Int. Cl.
*B02C 21/02* (2006.01)

(52) U.S. Cl. ..... 241/101.2; 241/101.741

(58) Field of Classification Search ..... 241/101.2, 241/101.74, 101.741
See application file for complete search history.

(56) References Cited

U.S. PATENT DOCUMENTS

| | | | | |
|---|---|---|---|---|
| 2,772,794 | A | 12/1956 | Cramer et al. | |
| 3,335,968 | A | 8/1967 | Young | |
| 4,052,013 | A * | 10/1977 | Ehrlich et al. | 241/101.2 |
| 4,134,556 | A * | 1/1979 | Ehrlich et al. | 241/79.3 |
| 5,542,617 | A | 8/1996 | Rajewski | |
| 5,676,320 | A | 10/1997 | Merklinger | |
| 5,847,470 | A | 12/1998 | Mitchell | |
| 5,871,162 | A | 2/1999 | Rajewski | |
| 6,491,245 | B1 | 12/2002 | Rajewski | |
| 6,719,226 | B2 | 4/2004 | Rajewski | |
| 6,979,913 | B2 | 12/2005 | Storm et al. | |
| 7,057,303 | B2 | 6/2006 | Storm et al. | |
| 7,198,213 | B2 | 4/2007 | Kolbet et al. | |
| 2003/0230655 | A1 * | 12/2003 | Giberson et al. | 241/101.2 |
| 2006/0032957 | A1 * | 2/2006 | Kolbet et al. | 241/101.74 |

(Continued)

FOREIGN PATENT DOCUMENTS

DE 31 38475 4/1983

(Continued)

OTHER PUBLICATIONS

*AXO Introduces New Mobile Shredders*, available at http://www.recyclingtoday.com/news/news.asp?ID=9797, dated Jul. 17, 2009, 2 pages.

(Continued)

*Primary Examiner*—Faye Francis
(74) *Attorney, Agent, or Firm*—Alston & Bird LLP

(57) ABSTRACT

A mobile shredder comprises a truck having an enclosure providing a storage volume for storage of shredded material, and a rotary shredder mounted in the enclosure outside the storage volume. A prime mover is disposed in an engine/transmission compartment of the truck. An electric motor is disposed outside the engine/transmission compartment and has an output shaft mechanically coupled to an input shaft of the rotary shredder. The rotary shredder is driven solely by the electric motor. An AC generator disposed outside the engine/transmission compartment is driven by the prime mover to generate the electrical power that powers the electric motor. The AC generator is configured to have a rated power output of about 90 to 180 kVA. The rotary shredder is configured to have a shredding capacity of 3000 to 6000 pounds per hour of typical mixed office waste when continuously operated at a nominal rated speed.

15 Claims, 4 Drawing Sheets

U.S. PATENT DOCUMENTS

2007/0152088 A1 7/2007 Kolbet et al.

FOREIGN PATENT DOCUMENTS

| | | |
|---|---|---|
| DE | 2006 006904 | 7/2006 |
| JP | 1 215638 | 8/1989 |

OTHER PUBLICATIONS

*AXO Introduces New Mobile Shredders*, available at http://www.sdbmagazine.com/news/news.asp?ID=7743&AdKeyvword=axo, dated Jul. 17, 2009, 2 pages.

*UpFront >>Equipment Report*, ...texterity.com/ .../pageviewer_pri..., available at www.sdbmagazine.com, dated Jan. 9, 2009, 2 pages.

*AXO HyGen Hybrid*, available at http://www.sdbmagazine.com/articles/article.asp?ID=5655&AdKeyword=axo+hygen, dated Jul. 17, 2009, 3 pages.

*AXO 408 Hygen*, The Hygen "Hybrid Shredding System", available at www.axo-shredders.com/pdf/AXO_Hygen_SpecSheet.pdf, May 4, 2007 (with Doucment Properties), 5 pages.

*The AXO Hygen Hybrid*, Overview, available at www.axo-shredders.com, dated Jan. 9, 2009, 1 page.

*AXO Hygen Hybrid*, Specification, available at www.axo-shredders.com, dated Jan. 9, 2009, 2 pages.

*AXO Has a Truck That Fits Your Business*!, available at www.axo-shredders.com, 1 page.

*We Have a Truck That Fits Your Business*, available at www.axo-shredders.com/pdf/AXO_Mobile_Flyer.pdf, Apr. 18, 2007 (with Document Properties), 3 pages.

*Freightliner Business Class® M2*, www.M2TOTHEMAX.com, 15 pages.

* cited by examiner

MOBILE SHREDDER

BACKGROUND OF THE INVENTION

The present invention relates to mobile shredders for shredding documents and other materials at customer sites.

With the increasing incidence of identity theft and other misuse of private or proprietary information, the desirability and necessity of protecting such information is becoming increasingly important. In recent years, laws have been passed in various jurisdictions regulating the use and protection by businesses, health care providers, and other entities, of sensitive or private information on customers, patients, and the like. At the federal level in the United States, the HIPAA and Gramm-Leach-Bliley laws require specific measures, such as document shredding, in order to comply with the laws' provisions for protecting certain designated types of information.

Discarding of sensitive documents in an unshredded state is risky because identity thieves, investigative journalists, and other unscrupulous individuals often engage in "dumpster diving" to retrieve documents from trash dumpsters or garbage cans. Accordingly, the demand for document shredding has surged. For entities having a small amount of documents requiring shredding, personal-sized shredders that are purchased or leased may be adequate. However, for many businesses and other organizations, the large volume of documents and other materials to be shredded makes such an approach impractical. Accordingly, document-shredding service providers have arisen to meet the increasing demand for large-volume shredding.

In the early history of document-shredding services, typically the documents to be shredded were picked up by the service provider and transported to a central facility for shredding. This form of shredding service still represents the prevalent one today. Central document shredding certainly can accomplish its intended purpose, if carried out properly. The drawbacks to central shredding include the necessity of strictly safeguarding the documents against theft or unauthorized access throughout the entire chain of custody from the time the documents are picked up from the customer to the time they are shredded, the necessity of properly documenting the chain of custody and the measures taken to safeguard the documents, and the fact that the users cannot independently verify that the documents were in fact shredded. This latter factor can give rise to a general sense of unease among some users of central shredding services.

Consequently, there is now a trend toward on-site document shredding using mobile shredders. A mobile shredder generally consists of a truck having a shredder mounted therein, and a storage volume for storing the shredded material. Typically, the users place the materials to be shredded in bins or "toters" that usually have wheels for rolling the bins to a location for pickup, such as a curbside location on a street. Mobile shredders typically have some type of bin lift and dump mechanism, such as those commonly employed on garbage collection trucks, for lifting the bins and emptying them into the shredder.

BRIEF SUMMARY OF THE INVENTION

The present invention is aimed at improving upon various aspects of mobile shredders. In accordance with one embodiment of the invention, a mobile shredder for shredding documents and other materials comprises a truck having a truck body defining an enclosure and including a partition in the enclosure that divides a storage volume from the remainder of the enclosure for storage of shredded material in the storage volume, and a rotary shredder mounted in the enclosure outside the storage volume. The rotary shredder includes an input shaft that, when rotated, drives the rotary shredder for shredding material. The truck has a prime mover comprising an internal combustion engine and a transmission disposed in an engine/transmission compartment of the truck for propelling the truck along the ground. The mobile shredder includes an electric motor disposed outside the engine/transmission compartment and having an output shaft. The output shaft of the electric motor is mechanically coupled to the input shaft of the rotary shredder such that operation of the electric motor causes the output shaft to rotate the input shaft of the rotary shredder for shredding material fed into the rotary shredder. The rotary shredder is driven solely by mechanical power provided by the electric motor.

In accordance with embodiments of the invention, the mobile shredder includes an AC generator system driven by the prime mover for generating the electrical power that powers the electric motor. The AC generator system comprises a power takeoff (PTO) unit mechanically coupled with the prime mover for extracting mechanical power from the prime mover, and an AC generator disposed outside the engine/transmission compartment. The PTO unit is mechanically coupled with the AC generator for rotatably driving the AC generator by the mechanical power extracted from the prime mover. The PTO unit is coupled with the AC generator via a coupling mechanism. An input to the coupling mechanism is rotated by the PTO unit at an input rotational speed. The coupling mechanism has an output that rotates at an output rotational speed equal to a predetermined multiple of the input rotational speed. The coupling mechanism drives the AC generator at the output rotational speed. In one embodiment, the ratio of output to input rotational speed in the coupling mechanism is approximately 1.1:1 (or more generally in a range of about 1.1:1 to 1.5:1). Accordingly, an input rotational speed of about 1600 rpm results in an output rotational speed of about 1800 rpm such that the AC generator produces alternating current of about 60 Hz.

In some embodiments of the invention, the rotary shredder is configured to have a shredding capacity of 3000 to 6000 pounds per hour of typical mixed office waste (i.e., copy paper, bond, colored paper, envelopes, etc.) when continuously operated at its nominal rated speed. Such rotary shredders require a mechanical power input of 60 to 125 HP. To accommodate such high shredding capacity, the AC generator is configured to have a rated power output of about 90 to 180 kVA, which corresponds to about 72,000 to 144,000 watts of 60 Hz 3-phase power, based on an 80% power factor.

The PTO unit preferably is selectively engageable with and disengageable from the prime mover, and the mobile shredder preferably includes a programmed controller operable to control engagement and disengagement of the PTO unit. The mobile shredder can include various sensors for monitoring conditions and detecting when it is safe or unsafe to engage or disengage the PTO unit. For example, in one embodiment, an engine RPM sensor can measure engine RPMs, and the controller can prevent the PTO unit from being engaged with or disengaged from the prime mover when the engine RPMs are above a predetermined limit. It is also possible to employ a transmission sensor to detect whether or not the transmission is in neutral or "park", and the controller can prevent the PTO unit from being engaged with the prime mover unless the transmission is in the proper gear.

In one embodiment of the invention, the mobile shredder includes an electric power cable having one end connected to the control panel for the shredder, and having a plug connected to the opposite end of the power cable. The plug can be inserted into an electric power receptacle connected to an electric utility grid, such that electric power for powering the electric motor is provided by the grid via the power cable, rather than by the AC generator. Thus, in this embodiment, the mobile shredder can be driven to a customer's facility and can be parked and the engine can be shut off. The power cable can then be withdrawn from the mobile shredder and routed to an electric power receptacle at the customer's facility, and the plug can be inserted into the receptacle. This is particularly advantageous when the mobile shredder is to be operated at a particular location for a prolonged period of time.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Overall System Description

The present disclosure relates to a mobile shredder generally of the type described in commonly owned U.S. Pat. No. 7,198,213, the entire disclosure of which is incorporated herein by reference. While the mobile shredder of the '213 patent functions extremely well, further improvements are sought. In particular, as further described below, the present mobile shredder represents a significant improvement over the mobile shredder described in the '213 patent, in that no complex hydraulic drive is required for powering the industrial-scale rotary shredder.

Figure 1:
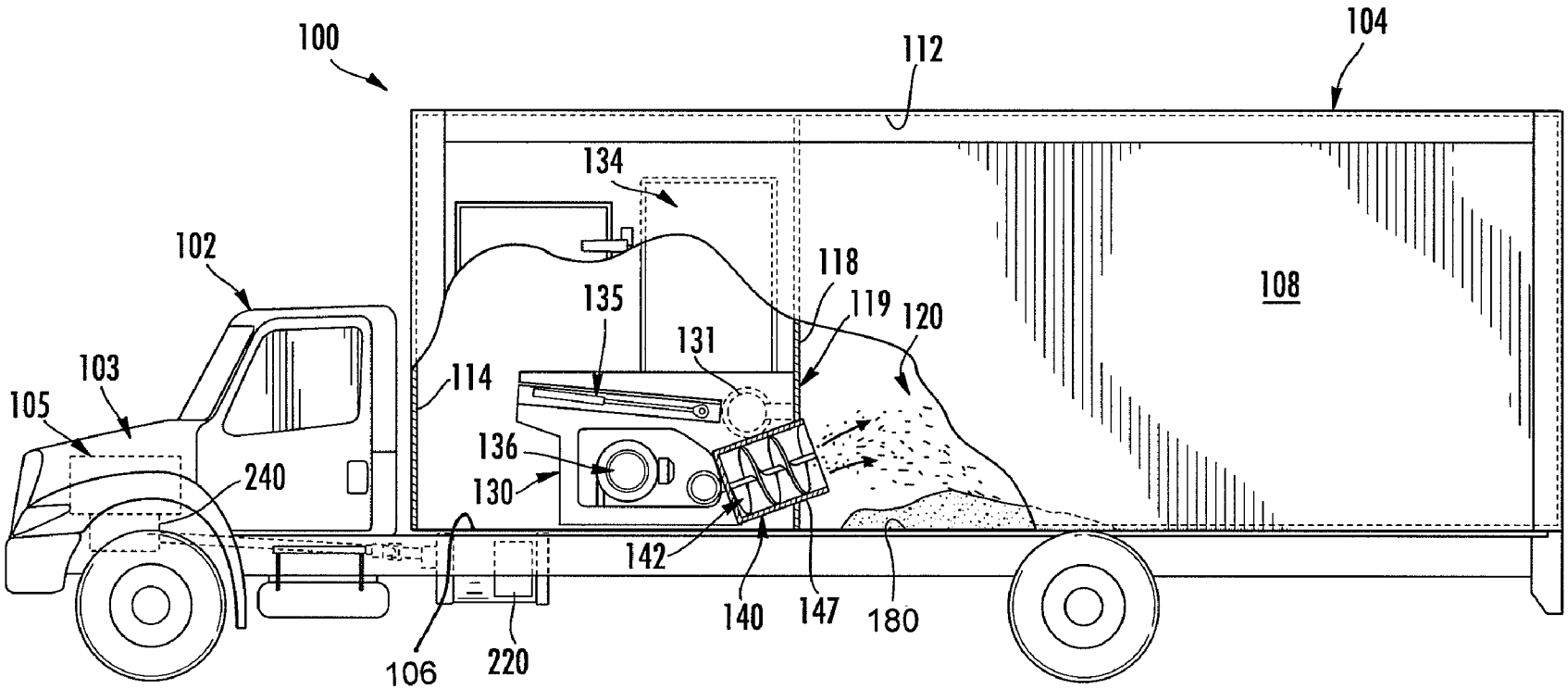
FIG. 1 is a road-side elevation of a mobile shredder in accordance with one embodiment of the invention, partially broken away to show internal features of the mobile shredder.
Figure 2:
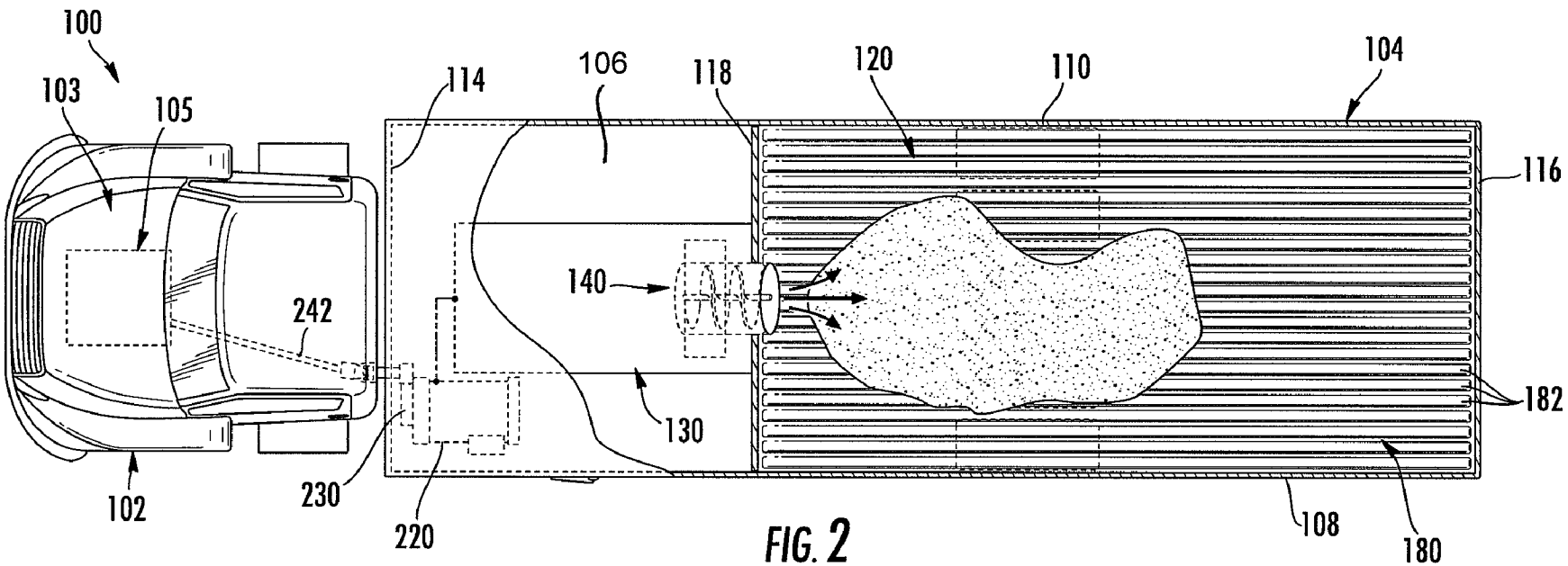
FIG. 2 is a top elevation of the mobile shredder of FIG. 1, partially broken away to show internal features of the mobile shredder.

A mobile shredder 100 in accordance with one embodiment of the invention is depicted in FIGS. 1-2. The mobile shredder 100 comprises a truck having a cab 102 for accommodating a driver and passenger, and a truck body 104 of generally box-shaped construction. The cab defines an engine/transmission compartment 103 in which a prime mover 105 (i.e., an internal combustion engine, typically a diesel engine, coupled with a transmission) is contained for providing the motive power to move the truck along the ground by driving two or more wheels of the truck in known fashion.

The truck body has a floor 106, a road-side wall 108, a curb-side wall 110, a ceiling 112, a front wall 114, and one or more rear doors 116. The walls 108, 110, 114 and ceiling 112 and rear door(s) 116 can comprise various materials, but advantageously comprise a fiber-reinforced polymer (FRP) material such as fiber glass or the like, for high strength-to-weight ratio.

The truck body defines an interior space that is subdivided into two portions by a partition 118 that extends between the two side walls 108, 110 at a location axially spaced behind the front wall 114. As further described below, the space between the partition 118 and the rear door(s) 116 defines a storage volume 120 for storage of shredded material. The space forward of the partition defines a location for the primary working components of the mobile shredder.

Thus, in the forward space of the truck body, a rotary shredder 130 is mounted on the floor 106. The rotary shredder receives material to be shredded, shreds the material into small flake-like pieces, and passes the shredded material to a discharge conveyor 140, which advantageously can comprise an auger as shown. The discharge conveyor is located forward of the partition 118 and is arranged to convey the shredded material through an opening in the partition into the storage volume 120.

Also located forward of the partition 118 is a bin lift and dump mechanism (not shown) operable to lift a bin containing material to be shredded and to tip the bin to dump the contents of the bin into the hopper 134 of the rotary shredder 130.

The floor of the storage volume 120, in one embodiment of the invention, comprises a linear conveyor or "live floor" 180. The live floor 180 is operable to discharge the shredded material out the rear end of the storage volume 120 when the rear door(s) 116 is/are opened. A pair of pivoting rear doors can be employed, or alternatively various other types of closure arrangements (e.g., a single pivoting door, a single roll-up door, etc.) can be used.

Rotary Shredder

The rotary shredder 130 is generally of the type described in U.S. Patent Application Publication No. US2004/0118958A1 and in European Patent EP 419 919 B1, the entire disclosures of which are incorporated herein by reference. The shredder comprises a rotor 131 that carries cutters, and a counter knife (not shown) that works in conjunction with the rotor to grind up or shred material fed into the space where the rotor and counter knife converge. The counter knife is generally stationary, although it can be flexibly supported so that it can "give" to some extent when a very hard object (e.g., a piece of metal or a rock) is inadvertently fed into the space between the rotor and counter knife, the flexibility thereby tending to prevent damage to the machine. The ground up or shredded material exits through a screen (not shown) having apertures suitably sized to regulate the size of the pieces of shredded material. The shredder 130 also includes a hopper 134 for receiving material to be shredded, and a hydraulic ram 135 for feeding the material into the space between the rotor and counter knife.

In operation, materials to be shredded are dumped into the infeed hopper 134 of the rotary shredder. The hydraulic ram 135 is operated to push the materials into the space between the rotor 131 and counter knife. The materials are shredded and pass through the screen into the discharge conveyor 140. The hydraulic ram 135 is driven by a hydraulic power unit (not shown), which in turn is driven by an electric motor 138, also referred to herein as the ram motor (see FIG. 3). Alternatively, the ram can be driven by an electrically powered actuator.

It is sometimes necessary or desirable to replace the screen of the shredder (e.g., with a screen having smaller or larger holes), and thus access to the screen area of the shredder should be readily available. However, access from the area forward of the partition 118 may not be possible. Accordingly, to facilitate access from the storage volume side of the partition 118, the partition advantageously includes a door 119 that can be opened so that a worker located in the storage volume 120 adjacent the partition can access the screen area of the shredder. Alternatively, access can be provided from the shredder side of the partition 118 in other embodiments.

Discharge Conveyor

The discharge conveyor 140 is best seen in FIG. 2. It comprises an auger 142 having helical flights mounted on a central shaft. The auger is disposed within a cylindrical casing 147 that defines an opening therein for receiving shredded material from the rotary shredder. The auger is driven by an electric motor 148 (FIG. 3), also referred to herein as the auger motor. The cylindrical casing 147 communicates with an opening through the partition 118 so that shredded material is fed by the auger 142 through the opening into the storage volume 120 of the truck. The auger advantageously is oriented such that its rotational axis is upwardly inclined in the rearward direction in which the shredded material is conveyed, such that the shredded material is moved upwardly as it is conveyed rearwardly, as shown in FIG. 2.

Alternatively, in other embodiments (not shown), the discharge conveyor can be another type of device such as a belt, a drag, or another known type of conveyor device.

Bin Lift and Dump Mechanism

The bin lift and dump mechanism is not specifically shown in the drawings since it is not central to the present invention. The lift and dump mechanism can comprise a bin-engaging member structured and arranged to grasp a bin that contains material to be shredded, and a powered lift device coupled with the bin-engaging member and operable to lift the bin-engaging member from a first position (e.g., ground level) generally vertically upward to a second position that places the bin in a generally upright orientation adjacent the rotary shredder 130, and operable then to move the bin-engaging member to a third position that tips the bin so as to dump the material to be shredded from the bin into the rotary shredder.

The lift and dump mechanism is located in an opening or channel in the curb-side wall 110 of the truck body. A movable door can be provided for covering the channel when the lift and dump mechanism is not being used, such as when the mobile shredder is traveling on the road.

Figure 3:
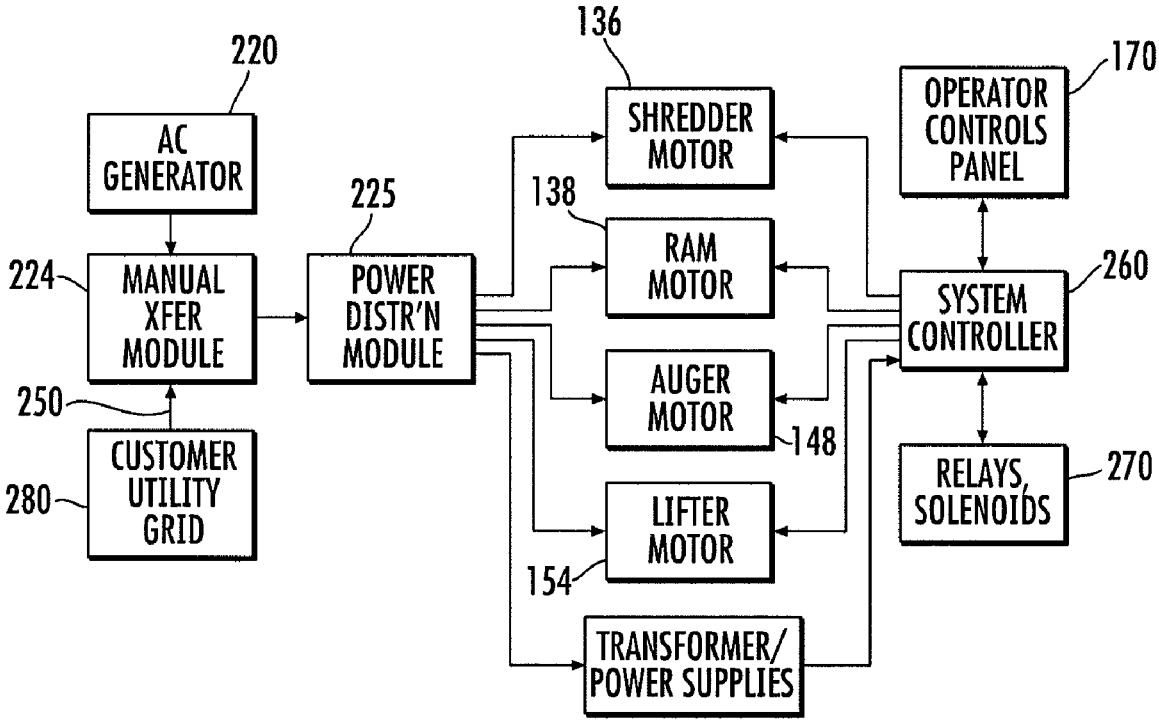
FIG. 3 is a diagrammatic illustration of an electrical system of the mobile shredder.

The lift and dump mechanism in one embodiment comprises a track member (not shown) in the shape of a "candy cane". A chain (not shown) runs along a channel extending the length of the track member. The bin-engaging member is connected to the chain. The chain is also engaged through suitable gears or sprockets with an electric motor 154 that is reversible, also referred to herein as the lifter motor (FIG. 3). When the motor is operated in one direction, the bin-engaging member is traversed upwardly from the lower end of the track member to its upper end to lift a bin from the ground and dump the contents into the shredder; the motor is then reversed to bring the bin-engaging member back down to lower the bin to the ground. Alternatively, the lift and dump mechanism can be driven by a hydraulic motor.

The operation of the lift and dump mechanism is also controlled by the programmed controller, which regulates operation of the electric lifter motor 154. Advantageously, the controller is programmed to control the lift and dump mechanism in such a way as to avoid overloading the rotary shredder 130. More particularly, the controller is programmed to prevent the lift and dump mechanism from tipping a bin to dump its contents into the rotary shredder whenever a load level of the shredder, as detected by a suitable sensor, is above a predetermined limit.

Live Floor

The live floor 180 comprises a plurality of axially extending, parallel slats 182 arranged in three groups that alternate in "a, b, c, a, b, c . . . " fashion. The slats advantageously are generally I-shaped in cross-section, having depending dovetails that are clamped in respective clamp members for the three groups of slats. All of the first clamp members are affixed to a transversely extending support plate so they move together as a unit, and likewise the second group of clamp members are affixed to support plate, and the third group of clamp members are affixed to support plate. Thus, each group of slats is independently movable, as a unit. Each group of slats is driven by its own hydraulic cylinder, and the three hydraulic cylinders form a drive unit. The hydraulic cylinders are operated in unison so that all of the slats 182 are advanced rearwardly at the same time so as to move the shredded material resting on the live floor toward the rear of the truck. Then one hydraulic cylinder is operated at a time to slide each group of slats forward. When one group at a time is moved, the pile of shredded material atop the live floor tends to stay in place because of the friction between the material and the two stationary groups of slats. Thus, the material is progressively moved rearwardly to move the shredded material out the open rear door(s) 116 of the truck.

Instead of hydraulically driving the live floor, alternatively the live floor can be driven by electrically powered actuators.

Operator Controls

The mobile shredder includes an operator controls panel 170 that includes control buttons for controlling the various components of the mobile shredder. The controls panel is connected with the system controller 260 (FIG. 3). The control buttons include: a lift and dump up button, and a lift and dump down button for interrupting operation of the lift and dump mechanism during an automatic cycle; a live floor start button and a live floor stop button; an auger start and keyed transmission lock; a system reset button and an emergency stop button; and a rotary shredder start button and an auger/rotary shredder stop button.

The controls panel 170 also includes a touch screen operable to display various types of information to an operator and further operable to allow the operator to interact with the programmed controller in various ways. The touch screen includes a number of regions that constitute interactive touch control buttons which, when touched, cause the programmed controller to execute various tasks. The programmed controller is programmed to display text and/or graphics in registration with one or more of the buttons to signify to the operator what operation will be carried out when each button is touched.

System Alarms

The system controller 260 advantageously is programmed to detect, via suitable sensors connected to the controller, various abnormal conditions of the mobile shredder and to initiate different levels of alarm depending on the abnormal condition that is detected. The alarm system advantageously includes relatively low-level alarms for certain conditions and higher-lever alarms for other more-serious conditions. For example, in one embodiment of the invention, the controller is operable to provide a relatively low level of alarm when the sensor system indicates an abnormal condition of the rotary shredder 130 or associated components, and to provide a relatively higher level of alarm when the sensor system indicates an abnormal condition of the truck.

Power Takeoff and AC Generator

As noted previously, the mobile shredder described herein represents an improvement over the mobile shredder described in U.S. Pat. No. 7,198,213 in that there is no complex hydraulic drive for driving the rotary shredder 130. Prior to the development of the present mobile shredder, the common practice in the mobile shredding industry had been (and continues to be) to drive the rotary shredder with a hydraulic drive supplied with pressurized hydraulic fluid from a hydraulic pump driven by a power take-off (PTO) unit engaged with the engine/transmission or "prime mover" of the truck. While this arrangement works well, the hydraulic drive and its associated valves and controls is a complex system, and personnel who are knowledgeable and trained to service and maintain such complex hydraulic systems are relatively rare. Additionally, the hydraulic drive can function only when the truck engine is running. The present mobile shredder addresses these issues.

In accordance with the present disclosure, the hydraulic drive and hydraulic pump are eliminated. The rotary shredder 130 is driven instead by an electric motor 136 (FIGS. 1 and 3). The electric motor 136, also referred to herein as the shredder motor, is mechanically coupled with and drives a belt or the like, which in turn drives a gearbox (not shown) of the rotary shredder. The shredder motor 136 advantageously is controlled by a variable-frequency drive (VFD), which is able to precisely control the speed of the motor and to reverse its direction if for example the shredder rotor becomes jammed by a hard object, under the control of the system controller.

The drive of the rotary shredder via the shredder motor 136 is made possible by the incorporation of a high-capacity AC generator system that supplies the high level of AC current and power required in order to drive the shredder. In preferred embodiments, the rotary shredder is sized and configured to operate at a throughput rate of about 3000 to 6000 pounds per hour of mixed office waste (i.e., copy paper, bond, colored paper, envelopes, etc.) when continuously operated at its nominal rated speed. Such rotary shredders require a mechanical power input of about 60 to 125 HP.

The AC generator system includes an AC generator 220 mounted outside the engine/transmission compartment 103 of the truck. The AC generator advantageously is a brushless 3-phase generator having a fixed stator and a rotating inductor, and preferably is self-ventilating and self-regulating. The AC generator preferably is a six-field, twelve-wire generator such that it can be operated in single-phase, 3-phase delta, or 3-phase star configurations. To accommodate the high shredding capacity of the rotary shredder, the AC generator is configured to have a rated power output of about 90 to 180 kVA, which corresponds to about 72,000 to 144,000 watts of 60 Hz 3-phase power, based on an 80% power factor. The AC generator system can be, for example, an AC generator system generally of the type described in U.S. Pat. No. 6,979,913 and U.S. Pat. No. 7,057,303, the entire disclosures of which are incorporated herein by reference. The AC generator generates a true sine wave output, and thus closely replicates the type of current typically supplied by an electric utility grid. This is particularly beneficial in those embodiments (described below) in which the various components powered by the AC generator can alternatively be powered from a utility grid via a power cable, because the character of the alternating current will be substantially similar in both cases.

Figure 4:
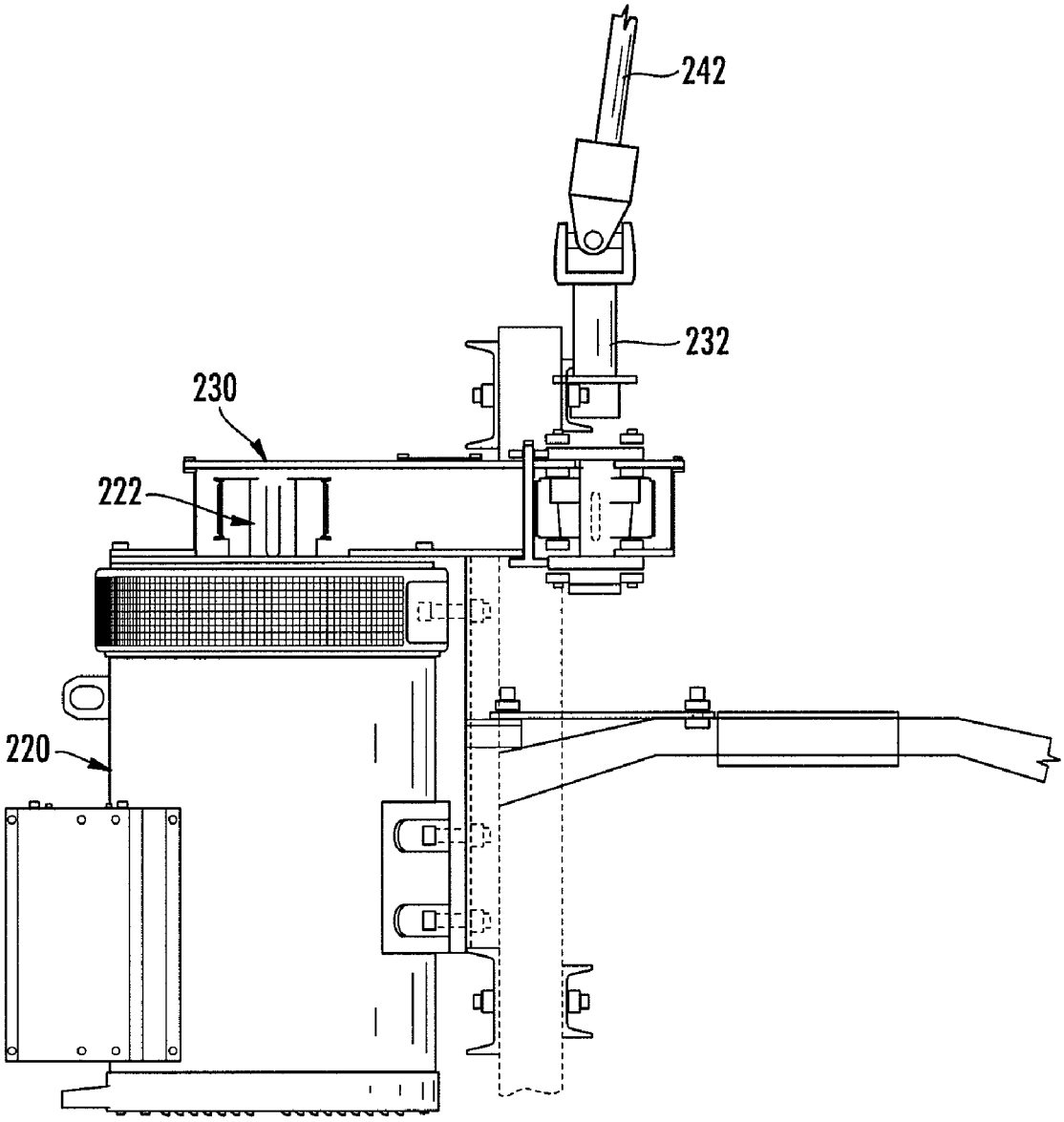
FIG. 4 is a top elevation of an AC generator system of the mobile shredder in accordance with one embodiment of the invention.

With particular reference to FIG. 4, the AC generator has a mechanical power input 222 that receives a rotatable input from a coupling mechanism 230. The coupling mechanism 230 is connected to a PTO unit 240 (FIG. 1) by a shaft 242 or the like. The PTO unit 240 is driven by the truck's transmission through an engageable and disengageable mechanical connection. A device such as a solenoid or the like is employed to selectively engage or disengage the PTO unit with the transmission. The solenoid can be biased to a disengaged position in the absence of an electrical signal and then urged to an engaged position when an electrical signal is sent to the solenoid. A relay can be used to supply the electrical signal to the solenoid only when predetermined criteria are met. The relay is under the control of a controller, such as the system controller for the mobile shredder or the truck engine/transmission programmable controller.

An input 232 to the coupling mechanism 230 is rotated by the shaft 242 at an input rotational speed. The coupling mechanism 230 has an output connected to the AC generator input 222 such that the coupling mechanism drives the AC generator at the output rotational speed determined by the gear ratio of the coupling mechanism. In one embodiment, the ratio of output to input rotational speed in the coupling mechanism is approximately 1.1:1 (or more generally in a range of about 1.1:1 to 1.5:1). Accordingly, an input rotational speed of about 1600 rpm results in an output rotational speed of about 1800 rpm such that the AC generator produces alternating current of about 60 Hz.

The AC generator 220 is connected for supplying electrical power to the shredder motor 136, to the ram motor 138, to the auger motor 148, to the lifter motor 154, and to the system controller 260 and associated components such as relays and solenoids 270, etc. It is also possible to drive the live floor 180 via an electric motor (not shown) powered by the AC generator. Thus, all of the various components of the mobile shredder can be powered by the AC generator, which derives its energy from the prime mover 105 via the PTO unit 240. This enables the mobile shredder components to be substantially independent of the truck cab and its prime mover, except for the mechanical connection from the transmission through the PTO unit to the AC generator.

In a typical truck of the type suitable for use as a platform for the mobile shredder, the truck includes an engine control module or ECM that accurately controls the speed of the engine under a variety of operating conditions. In some trucks of this type designed for connection of a PTO unit, the ECM and transmission control module have a PTO program whereby the prime mover is regulated to operate at an engine speed that is maintained substantially constant but at a level higher (for example, 80% to 120% higher) than the normal idling speed. The coupling mechanism 230 between the PTO unit's output shaft 242 and the input 222 of the AC generator is designed so that the rotational speed of the AC generator 220 is the proper speed to replicate a utility sine wave. Generally speaking, the AC generator's optimum speed is 1800 rpm in order to produce 60 Hz AC current (which is the standard utility frequency in the U.S.). The 50 Hz current commonly used in other countries necessitates a generator speed of 1500 RPM. The speed of the generator is precisely controlled to the appropriate speed by virtue of the governing aspect of the truck's ECM, which varies the rate of fuel delivered to the engine to keep a constant engine speed as the electrical loads on the generator (and thus the mechanical loads on the PTO) are varied, in concert with the coupling mechanism 230 whose input/output speed ratio is appropriately selected based on the known input speed.

Before the solenoid controlling engagement of the PTO unit can be activated to engage the PTO unit, the automatic transmission of the truck must be in park, or if a manual transmission, in neutral with the vehicle parking brake set. Additionally, an operator switch (not shown) must be in the "on" position, and the vehicle ignition switch must also be "on". When these conditions are satisfied, the solenoid engages the PTO unit 230 to drive the AC generator 220. The appropriate controls in the vehicle are set to operate the engine in accordance with the PTO program as previously described. The AC generator supplies electrical power to the various components as previously noted. This continues until either (1) the operator switch is turned off, (2) the ignition switch is turned off, (3) an emergency switch is activated, or (4) an over-temperature sensor indicates too high a temperature through the output box.

FIG. 3 is a diagrammatic illustration, at a simplified high-level view, of the electrical system for the mobile shredder. The AC generator 220 is connected via a power transfer module 224 to a power distribution module 225, through which the electrical power produced by the generator is distributed to the various components of the mobile shredder. The power distribution module contains a main circuit breaker and multiple branch circuits for connection to the various components via suitable wiring or cables (referred to generically as "electrical lines" herein). Thus, an electrical line is connected from the power distribution module to the transformer/power supplies that provide electrical power for the system controller 260. Electrical lines are also connected from the power distribution module to the shredder motor 136 (and to its associated variable-frequency drive), the ram motor 138, the auger motor 148, and the lifter motor 154 for powering each of these motors. Electrical lines also extend from the system controller 260 to various relays and/or solenoids, collectively denoted by reference number 270. The relays and solenoids are controlled by the controller for regulating operation of the various motors and other components of the mobile shredder.

The system controller 260 is connected by suitable control cables or wires to the controllers for the shredder motor 136 and its variable-frequency drive, the ram motor 138, the auger motor 148, the lifter motor 154, and the relays/solenoids 270. Although not shown, it will be understood that feedback loops from these controlled components to the system controller 260 can be employed for closed-loop control of the components. The system controller is also connected to the operator controls panel 170 that has an interface such as a touch screen for an operator to control various operations of the mobile shredder.

Alternate Power Via Utility Grid

As briefly noted above, the mobile shredder in some embodiments has the capability to be powered either by the AC generator 220 or by a utility grid 280 carrying 60 Hz AC current (in North America) or 50 Hz AC current (outside North America). This is made possible by the provision of the manual transfer module 224 that is connected to the power distribution module 225. The manual transfer module receives electrical power (whether from the AC generator or from the utility grid) and transfers it to the power distribution module 225. A power cable 250 supplied by the customer can be connected between the customer's utility grid 280 and the manual transfer module. The power cable is terminated at both ends by plugs, one of which can be plugged into a standard electrical receptacle on a circuit properly rated to supply the required current from the utility grid, and the other of which can be plugged into a receptacle provided on the manual transfer module. When the power cable is employed, the mobile shredder can be operated from the grid power and the engine can be turned off. This is particularly beneficial when the mobile shredder is to be operated at the same location for a long period of time.

In summary, in accordance with the invention, the mobile shredder is powered substantially entirely, or in some embodiments entirely, by electric motors. More particularly, in the "all-electric" embodiments, the shredder, its ram, the discharge auger, the bin lift and dump mechanism, and the live floor all can be driven by electric motors powered by the AC generator system. Any or all of these motors can be driven via a variable-frequency drive (VFD) allowing the speed of each motor to be precisely controlled.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A mobile shredder for shredding documents and other materials, comprising:

a truck having a truck body defining an enclosure, and including a partition in the enclosure that divides a storage volume from the remainder of the enclosure for storage of shredded material in the storage volume;

a prime mover disposed in an engine/transmission compartment of the truck, comprising an internal combustion engine and a transmission for propelling the truck along the ground;

a shredder mounted in the enclosure outside the storage volume, the shredder having an input shaft that, when rotated, drives the shredder for shredding material;

an electric shredder motor disposed outside the engine/transmission compartment and having an output shaft mechanically coupled to the input shaft of the shredder such that operation of the electric shredder motor causes the output shaft to rotate the input shaft of the shredder for shredding material fed into the shredder, whereby the shredder is driven solely by mechanical power provided by the electric shredder motor;

an AC generator system driven by the prime mover for generating the electrical power that powers the electric shredder motor, the AC generator system comprising a power takeoff (PTO) unit mechanically coupled with the prime mover for extracting mechanical power from the prime mover, and an AC generator disposed outside the engine/transmission compartment, the PTO unit being mechanically coupled with the AC generator for rotatably driving the AC generator by the mechanical power extracted from the prime mover;

a power distribution module electrically connected to the electric shredder motor for distributing electrical power to the electric shredder motor; and a manual transfer module electrically connected between the AC generator and the power distribution module, the manual transfer module being structured and arranged to be connected to an electric utility grid to receive electrical power therefrom, such that electrical power for powering the electric shredder motor is selectively obtainable either from the grid or from the AC generator when the manual transfer module is not connected to any grid.

2. The mobile shredder of claim 1, wherein the PTO unit is coupled with the AC generator via a coupling mechanism, an input to the coupling mechanism being rotated by the PTO unit at an input rotational speed, and the coupling mechanism having an output that rotates at an output rotational speed the same as or different from the input rotational speed, wherein the coupling mechanism drives the AC generator at the output rotational speed.

3. The mobile shredder of claim 2, wherein the ratio of output to input rotational speed in the coupling mechanism is approximately 1.1:1 to 1.5:1.

4. The mobile shredder of claim 1, wherein the AC generator is configured to have a rated power output of about 90 to 180 kVA.

5. The mobile shredder of claim 4, wherein the shredder is configured to have a shredding capacity of 3000 to 6000 pounds per hour of typical mixed office waste when continuously operated at a nominal rated speed.

6. The mobile shredder of claim 1, further comprising a bin lift and dump mechanism operable to lift a bin containing material to be shredded and dump the material from the bin into an infeed hopper leading to the shredder.

7. The mobile shredder of claim 6, further comprising an electric motor driving the bin lift and dump mechanism and powered by electrical power from the power distribution module and manual transfer module.

8. The mobile shredder of claim 1, further comprising a discharge conveyer arranged to receive shredded material from the shredder and discharge the shredded material into the storage volume.

9. The mobile shredder of claim 8, further comprising an electric motor driving the discharge conveyor and powered by electrical power from the power distribution module and manual transfer module.

10. The mobile shredder of claim 1, wherein the shredder comprises a single-shaft rotary shredder having a rotor supporting cutters and arranged proximate a stationary counterknife such that a space for receiving material to be shredded is defined between the rotor and the counterknife, and further comprising a ram disposed above a surface onto which material to be shredded is deposited from the infeed hopper, the ram being controllably extendable for advancing material to be shredded along said surface into the space between the rotor and the counterknife.

11. The mobile shredder of claim 1, further comprising a live floor in the storage volume and operable to progressively move shredded material in the storage volume rearwardly.

12. The mobile shredder of claim 1, further comprising a variable-frequency drive operable to control a speed of the electric shredder motor.

13. The mobile shredder of claim 1, wherein the shredder is located forward of the partition in a forward space of the enclosure, and further comprising a discharge conveyor arranged for receiving shredded material from the shredder and conveying the shredded material rearwardly through an opening in the partition into the storage volume.

14. The mobile shredder of claim 13, wherein the discharge conveyor comprises an auger rotatable about an axis, and wherein the auger is oriented with the axis upwardly inclined relative to horizontal in a rearward longitudinal direction such that the shredded material is moved upwardly as it is conveyed rearwardly into the storage volume.

15. The mobile shredder of claim 1, further comprising a door in the partition for access by maintenance personnel to the shredder.

* * * * *